United States Patent [19]

Finch

[11] 4,120,226

[45] Oct. 17, 1978

[54] CIRCUIT FOR REITERATING PERCUSSIVE SOUNDS IN ELECTRONIC MUSICAL INSTRUMENT

[75] Inventor: Robert A. Finch, Palos Park, Ill.

[73] Assignee: CBS Inc., New York, N.Y.

[21] Appl. No.: 813,641

[22] Filed: Jul. 7, 1977

Related U.S. Application Data

[63] Continuation of Ser. No. 680,220, Apr. 26, 1976, abandoned.

[51] Int. Cl.[2] ..... G10F 1/00

[52] U.S. Cl. ..... 84/1.03; 84/1.24; 84/DIG. 8; 84/1.17

[58] Field of Search ..... 307/267, 265, 266; 84/1.01, 1.03, 1.25, 1.24, DIG. 8, 1.17

[56] References Cited

U.S. PATENT DOCUMENTS

| | | | |
|---|---|---|---|
| 3,378,624 | 4/1968 | Markowitz | 84/1.25 |
| 3,476,864 | 11/1969 | Munch et al. | 84/1.03 |
| 3,548,066 | 12/1970 | Freeman | 84/1.03 |
| 3,571,626 | 3/1971 | Reif | 307/267 X |
| 3,617,602 | 11/1971 | Kniepkamp | 84/1.24 X |
| 3,629,482 | 12/1971 | Pulfer et al. | 84/1.03 |
| 3,787,601 | 6/1974 | Campbell | 84/1.03 |
| 3,789,718 | 2/1974 | Bunger | 84/1.03 X |
| 3,795,755 | 3/1974 | Uchiyama | 84/1.03 |
| 3,974,729 | 8/1976 | Koike | 84/1.03 |

*Primary Examiner*—Ulysses Weldon
*Attorney, Agent, or Firm*—Spencer E. Olson

[57] ABSTRACT

For reiteration of percussive sounds in an electronic organ there is provided a circuit for generating pulse signals for reiteration control which are "on" for much longer periods than they are "off", thereby substantially reducing the chance of an organ key being actuated when the control signal is in its "off" condition. The circuit is so arranged that playing of an additional key at a time when one or more other keys are being held has no effect on the reiteration of the sound produced by the held keys. The circuit generates four control signals which are connected such that each controls three notes in a given octave on the keyboard, a different three in successive octaves, such that when normal intervals (e.g., thirds, fourths and fifths) are played, the effect of random reiteration control is produced.

7 Claims, 3 Drawing Figures

CIRCUIT FOR REITERATING PERCUSSIVE SOUNDS IN ELECTRONIC MUSICAL INSTRUMENT

This is a continuation, of application Ser. No. 680,220, filed Apr. 26, 1976 now abandoned.

BACKGROUND OF THE INVENTION

1. Field of the Invention

The present invention relates to electronic musical instruments, and more particularly to a system for providing reiteration of percussion sounds in an electronic organ.

2. Prior Art

Electronic musical instruments, such as electronic organs, often include a system for automatically reiterating a sound corresponding to a note so long as the keyswitch for that note is depressed to produce percussion effects such as the sound of a xylophone or a marimba. The usual way of producing reiteration of a percussion note is to apply a DC voltage produced by depression of a keyswitch as one input to an AND gate, and to apply as the other input to the AND gate a reiterating signal, such as a signal of rectangular waveform having a frequency corresponding to the desired reiteration rate (e.g., five times a second), and utilizing the output of the AND gate to control an audio gate, which is operative to connect a signal from a tone generator to a filtering and amplifying means. Thus, as the key is held, the reiteration signal goes "on" and "off", alternately closing and opening the audio gate, causing the played note to reiterate at a predetermined rate.

In prior art systems of this kind of which applicant is aware, the duty cycle of the reiterating signal is fifty percent or less; that is, it is at its positive level half of the time or less and "off" for half of the time or longer. While the reiterating signal is always present as one input to the AND gate, because it is ineffective half or more of the time to open the AND gate, if one plays the keys of the organ rapidly there is a good chance that the reiterating signal will be at its "off" condition at the instant a key is played, and no sound will be produced. This is very disconcerting to the organist who when playing at his own tempo plays a key and no sound is produced. One proposed solution for this problem is to provide in the reiteration system a circuit that produces an enabling reiteration pulse any time any keyboard key is actuated, thereby assuring production of a sound in response to the initial depression of the key. However, with this arrangement, if any key is being held at the time an additional key or keys are played, all of the actuated keys will strike at the same time, causing a strange and generally objectionable percussion sound.

SUMMARY OF THE INVENTION

It is a primary object of the present invention to provide a reiteration system suitable for use in an electronic organ wherein the above-described drawbacks of heretofore proposed reiteration systems can be substantially eliminated.

Briefly, this and other objects are achieved by providing a reiteration signal having a waveform such that the percussive enabling circuit is "on" for much longer periods than it is "off", for example, one which is at its positive or "up" level 90% of the time and "down" 10% of the time, thereby substantially reducing the chance of actuating a key at a time when the reiteration signal is at its "down" level. While it is statistically possible that a key may be actuated when the reiteration signal is "down", it has been found in practice that the probability of this happening is very small, and that a sound is essentially always produced on the first strike of the key. The need for the aforementioned circuit for producing an enabling reiteration pulse any time a key is activated is thus eliminated with the beneficial result that playing of an additional key at a time when one or more other keys are being held has no effect on the reiteration of the sound produced by the held keys.

In a pipe organ (which the electronic organ desirably simulates) on percussive sounds such as xylophone, orchestral bells, etc., each note has its own reiterative circuit so that whenever a note is played, one attendant percussive sound reiterates independently of another percussive sound in random fashion to produce a pleasant sound. In a typical electronic organ, however, in which it is prohibitively expensive to provide a separate reiteration circuit for each note, when two or more percussive sounds are produced simultaneously, because they reiterate at the same rate and in synchronism, they do not have the "natural" sound of the pipe organ. It is another object of the present invention to provide a reiteration system which introduces a randomness to the percussive sounds produced by an electronic organ.

Briefly, this object is accomplished by providing, in an illustrative embodiment, four reiteration control signals having a waveform as described above, two of which, constituting a first pair, are 180° out of phase relative to each other, and the other two of which, constituting a second pair, are also 180° out of phase with each other but of slightly different frequency than the signals of the first pair, such that the phase relationship between like signals of the two pairs varies in a random fashion, sometimes being in phase, sometimes 180° degrees out of phase, and at other times at other phase relationships between these limits. For any octave of notes on the keyboard, the second inputs of the AND gates, of which there is one for each key, are connected to receive the four reiteration control signals in such a manner that when normal intervals (e.g., thirds, fourths and fifths) are played, the keys played are not connected to the same control signal thereby producing the effect of random reiteration control.

BRIEF DESCRIPTION OF THE DRAWINGS

Other objects, features and advantages of the invention will become evident, and its construction and operation will be better understood, from the following detailed description read in conjunction with the accompanying drawings, in which.

DESCRIPTION OF THE PREFERRED EMBODIMENT

Figure 1:
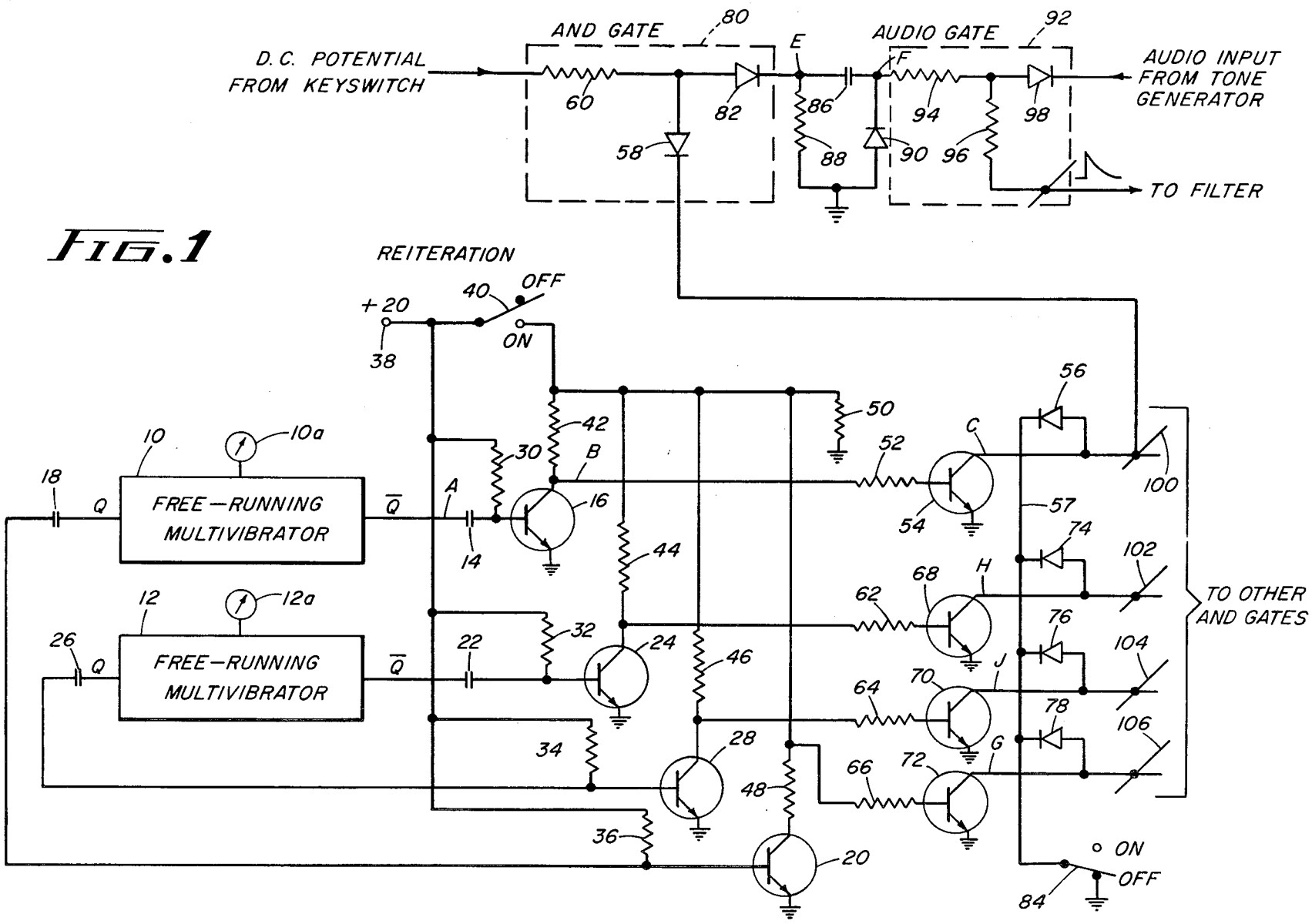
FIG. 1 is a schematic diagram of a reiteration control system embodying the invention.

Referring to FIG. 1, the ultimate reiteration control signals for application to the logic gates (to be described) are operated and timed by first and second similar free-running multivibrators 10 and 12 which operate at approximately the same frequency and each of which is adjustable in frequency by a respective tuning adjusting means diagrammatically shown at 10a and 12a. Each of the multivibrators produces at its two output termianals an output signal of square waveform and fifty percent duty cycle, the signal at one output terminal being 180° out of phase with respect to the signal at the other output terminal. Thus, the two output signals from multivibrator 10 are locked in phase with each other, and the two output signals from multivibrator 12 are phase-locked, but because the multivibrators are independent from each other, the output signals from one are not phase-locked with the output signals from the other; however, because they operate at approximately the same frequency, statiscally, one of the output signals from multivibrator 10 may sometimes be in phase with one of the output signals from multivibrator 12 and 180° out of phase with the other, and at other times, 180° out of phase with the said one output signal from multivibrator 12 and in phase with the other, or in any phase relationship between these limits. The same is true of the output signals from multivibrator 12 as compared to the signals from multivibrator 10. The significance of the randomness of the phase relationships between the output signals from the two multivibrators will become evident as the description proceeds.

Figure 2:
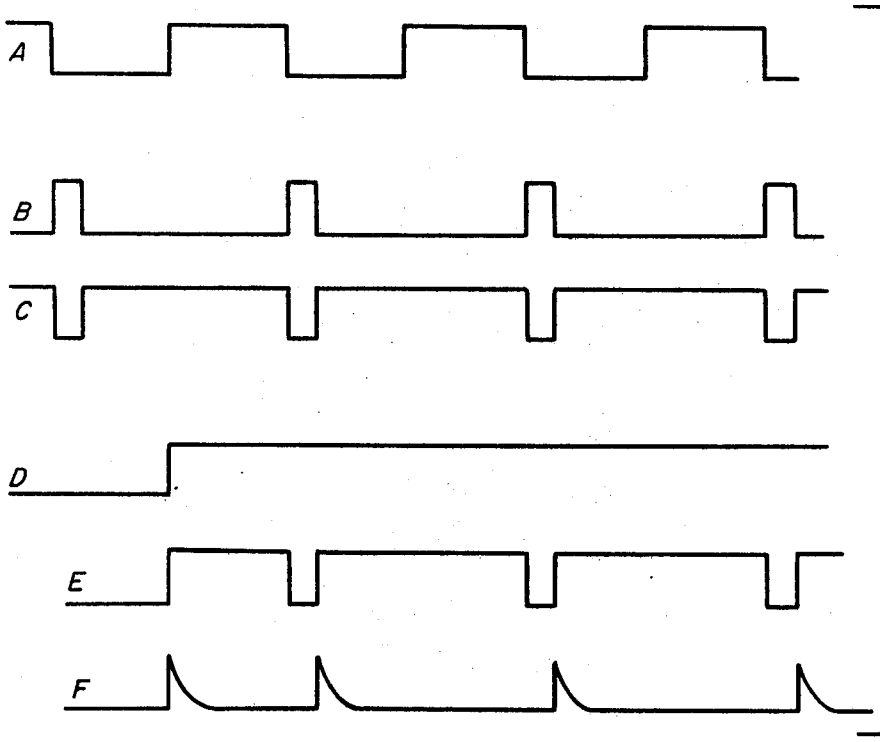
FIG. 2 are a series of waveforms used to explain the operation of the system of FIG. 1.

The fifty percent duty cycle of the pulse signals from the multivibrators is converted to the desired approximate 90 percent duty cycle for the reiteration control circuit by pulse-shaping circuitry now to be described. The $\overline{Q}$ output signal from multivibrator 10, shown as waveform A in FIG. 2, is coupled via a capacitor 14 to the base electrode of a transistor 16, and its Q output signal is coupled via capacitor 18 to the base electrode of transistor 20. Similarly, the $\overline{Q}$ and Q output signals from multivibrator 12 are respectively coupled via capacitors 22 and 26 to the base electrodes of transistors 24 and 28, respectively. The base electrodes of transistors 16, 24, 28 and 20 are connected via respective base resistors 30, 32, 34 and 36 to a source of DC potential, for example, 20 volts, represented by terminal 38, the emitter electrode of each of the transistors is connected to a source of reference potential, such as ground as shown, and the collector electrodes of the transistors are connected to the potential source 38, when a reiteration switch 40 is actuated to its "on" position, via respective load resistors 42, 44, 46 and 48. Corresponding components associated with the four transistors have the same circit values; in a system which has been satisfactorily operated, the transistors are type 2N2924, the coupling capacitors each have a value of 0.22 mf, the base resistors each have a resistance of 150K ohms, the collector load resistors each have a resistance of 2.2K ohms, and the resistor 50 connected between the potential source and ground has a value of 10K ohms. Thus, each of the transistors and associated circuitry functions in the same way to shape its applied square waveform signal; accordingly, the description to follow of the operation of transistor 16 and its associated circuitry is equally applicable to the other three.

Upon energization of transistor 16 by closure of switch 40, the RC combination of resistor 30 and capacitor 14 having the values mentioned earlier operates to differentiate the square wave signal (waveform A in FIG. 2) to produce at the collector electrode narrow positive-going pulses in response to only the negative-going excursions of the square wave, the leading edges of which are coincident with the leading edges of the negative-going square wave pulses and the duration of which is typically about 10 percent of the duration of one cycle of the square wave. The signal which appears at the collector electrode is illustrated as waveform B in FIG. 2. This signal is applied via resistor 52 to the base electrode of a transistor 54, the emitter electrode of which is grounded and the collector electrode of which is connected via a line 100, a diode 58, and a resistor 60 to a source of DC potential which is available only when a keyswitch of the organ is actuated. The collector electrode of transistor 54 is also connected to line 57 via diode 56. Thus, at such times as a keyswitch is actuated, but only then, resistor 60 serves as the collector load for transistor 54, causing the applied signal to be inverted and appear at the collector electrode; the resulting repetitive pulse signal on line 100 is shown as waveform C in FIG. 2 and is seen to be down or "off" for about 10 percent of each cycle and at its positive level, or "on", for about 90 percent of each cycle.

To complete the description of the remainder of that portion of the system thus far considered, the collector electrodes of transistors 24, 28 and 20 are connected via respective resistors 62, 64 and 66 to the base electrodes of inverting amplifier transistors 68, 70 and 72, respectively, the collector electrodes of which are coupled via lines 102, 104 and 106, respectively, to corresponding points in other similar circuits, and to line 57 by respective diodes 74, 76 and 78. Thus, signals from each of transistors 54, 68 and 72 similar to waveform C will apear on lines 102, 104 and 106, respectively, during such times as there are DC potentials applied at points D in other, similar circuits in response to actuation of the keyswitches connected thereto. A switch 84 connected from line 57 to ground potential, together with diodes 56, 74, 76 and 78 serve as a secondary means of turning "off" the entire reiteration control signal; that is, when switch 84 is actuated to its "off" position, no reiteration control signals are generated. If switch 40 is "off" when switch 84 is "on", the percussion circuit is operative, but without reiteration. How the four repetitive pulse signals differ from each other will be described subsequently, following a description of how the signal appearing at the collector of transistor 54 (waveform C) is utilized to control reiteration of the sound produced by a played key.

The reiteration control signal is generated by applying the pulse signal on line 100 as one input to a logic gate, in this illustrative embodiment, and AND gate 80 consisting of diode 58 and another diode 82 whose anodes are connected together and to one terminal of resistor 60, and applying as a second input, to the other terminal of resistor 60, a DC voltage from the keyswitch connected thereto. The applied DC voltage is applied as long as the keyswitch is actuated (that is, as long as the key on the keyboard is held depressed); its waveform is as shown in waveform D of FIG. 2, the positive-going excursion occuring upon initial depression of the key. The AND gate is operative to produce an output at the anode of diode 82 (point E) only when both input signals are at their positive levels; thus, a pulse signal as depicted by waveform E in FIG. 2 is produced at point E, which has negative-going excursions in timed relationship with the negative-going excursions of waveform C.

The signal appearing at point E is then applied to a pulse-forming network consisting of a small capacitor 86, typically having a value of 0.47 mfd, and a resistor 88, typically having a resistance value of 100K ohms, and a diode 90, which is operative to produce at the junction of capacitor 86 and diode 90 (point F) a series of sharp pulses the positive-going leading edges of which are coincident with the positive-going excursions of waveform E. The diode 90 and resistor 88 function to reset the pulse-forming network to discharge capacitor 86 as soon as the positive-going excursion of waveform E is removed, producing pulses having the decay characteristic depicted by waveform F of FIG. 2 and readying the network to accept another pulse from the collector of transistor 54. Thus, the system is able to accept other control pulses at any time other than during the short period of the sharp pulses shown in waveform F.

The pulses appearing at point F are applied, without further shaping, as one input to an audio gate 92 consisting of resistors 94 and 96, and diode 98, to which is applied as the second input an audio signal from a tone generator having a frequency corresponding to the note associated with the key connected to point D, the audio signal being always present whether the key is struck or not. Thus, the audio gate 92 is operative to couple the audio signal to suitable filter and voicing circuitry (not shown) at and during the times determined by the envelope of the pulses of waveform F, thereby to reiterate the sound associated with the played key for so long as the key is depressed.

It is to be understood that an electronic organ would include one of the just-described AND gate-audio gate combinations for each key of the organ keyboard, but that only a single control producing system (i.e., the two multivibrators 10 and 12 and associated circuitry) is required to actuate the multiplicity of AND gates, as indicated by the connection points 100, 102, 104 and 106. More particularly, the four control signals appearing at these four points are so distributed among the AND gates (one for each key) in such a way that when playing normal intervals (e.g., thirds, fourths and fifths), the keys played are not connected to the same control signal whereby to create the effect of random reiteration controls. For example, in a first octave utilizing reiteration, the control signal appearing at point 100 might be connected to the AND gates associated with the notes C, C# and D, the control signal at point 102 connected to control notes D#, E and F, the control signal at point 104 connected to control notes F#, G and G#, and the control signal at point 106 connected to control notes A, A# and B. In the next octave, the first three notes are controlled by the signal appearing at point 102, the next three notes are controlled by the signal at point 104, the next three by the signal at point 106, and the fourth three by the signal at point 100. Similarly, in the next successive octave, the first three notes are connected to point 104, the next three to point 100, and the final three to point 102.

Figure 3:
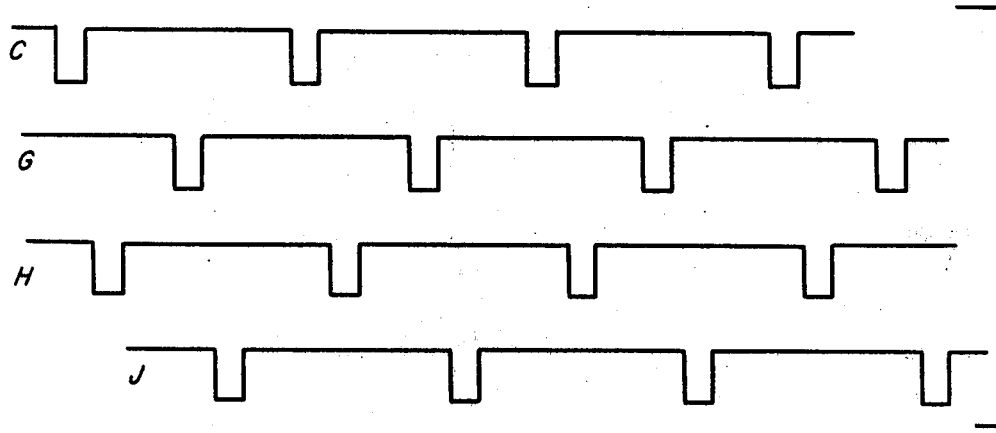
FIG. 3 illustrates another set of waveforms used to explain the invention.

How the described connections in combination with the reiteration control circuit introduce randomness in the control, and guarantee getting two notes from different octaves to reiterate when notes from different octaves are played simultaneously, will be evident from examination of FIG. 3 wherein the signals appearing at the collectors of transistors 54, 72, 68 and 70 are depicted as waveforms C, G, H and J, respectively. Being derived from the two outputs of free-running multivibrator 10, the signals C and G are 180° out of phase with each other. However, the latter two signals are not phase-locked to signals C and G and may go in and out of phase therewith, randomly, because of the slight differences in the frequency of the multivibrators 10 and 12.

Although a specific embodiment has been described to illustrate the principles of the invention, it will now be evident to ones skilled in the art that various modifications are possible without departing from the spirit of the invention. For example, the pulse forming and shaping circuits can take forms other than those described, and the AND gate may employ negative logic rather than the described positive logic. It is intended to embody within the scope of the patent warranted hereon all such modifications as reasonably and properly come within my contribution to the art.

I claim:

1. In an electronic organ having a plurality of keyswitches wherein actuation of each keyswitch acts to apply as one of two inputs to a respective one of a like plurality of logic gates a DC potential of predetermined amplitude, and wherein conduction of a logic gate acts to cause an associated one of a like plurality of audio gate circuits to couple from a tone generator to output utilization means a single note of a musical scale corresponding to the actuated keyswitch, a reiteration circuit for automatically reiterating a sound corresponding to a note for so long as the keyswitch for that note is depressed to produce percussion effects, said system comprising:

pulse generating means for producing a repetitive substantially rectangular waveform pulse signal having a first voltage level during a substantially greater portion of each cycle than it has a second voltage level, which first level being sufficient when applied as a second input to a logic gate simultaneously with application of said DC potential as a first input to render said logic gate conducting and said second level being incapable of rendering a logic gate conducting when applied thereto simultaneously with the application of said DC potential, whereby to minimize the chance of a keyswitch being actuated when said repetitive pulse signal is at said second level; and means connecting said pulse generating means to said logic gates for coupling said repetitive pulse signal as a second input to selected ones of said logic gates.

2. Apparatus in accordance with claim 1, wherein said pulse generating means comprises a free-running multivibrator operative to produce first and second square waveform signals of predetermined frequency which are out of phase relative to each other, and pulse-shaping means for separately modifying said first and second square waveform signals to produce two of said repetitive pulse signals which are out of phase relative to each other; and wherein said connecting means couples one of said repetitive pulse signals to each of a first group of logic gates whose associated audio gates control a first preselected set of notes in a given octave and couples the other of said repetitive pulse signals to each of a second group of logic gates whose associated audio gates control a second preselected set of notes in said given octave.

3. Apparatus in accordance with claim 2, further including a second free-running multivibrator for producing third and fourth square waveform signals of substantially said predetermined frequency which are out of phase relative to each other and not locked in phase with said first and second square waveform signals, and pulse-shaping means for separately modifying said third and fourth square waveform signals to produce another two of said repetitive pulse signals which are out of phase relative to each other; and wherein said connecting means couples one of said second two repetitive pulse signals to a third group of logic gates whose associated audio gates control a third set of preselected notes in said given octave and couples the other of said second two repetitive pulse signals to a fourth group of logic gates whose associated audio gates control a fourth set of preselected notes in said given octave.

4. Apparatus in accordance with claim 3, wherein said connecting means couples said four repetitive pulse signals to first, second, third and fourth groups of logic gates whose associated audio gates respectively control first, second, third and fourth sets of preselected notes in an octave other than said given octave; and wherein at least one of the preselected notes of each of the first, second, third and fourth sets in said other octave is different from the preselected notes of the first, second, third and fourth sets, respectively, in said given octave, whereby to create the effect of random reiteration control.

5. In an electronic organ having a plurality of keyswitches wherein actuation of each keyswitch acts to apply a DC potential of predetermined amplitude as one of two inputs to a respective one of a like plurality of logic gates, and wherein conduction of a logic gate acts to cause an associated one of a like plurality of audio gates to couple from a tone generator to output utilization means a single note of a musical scale corresponding to the actuated keyswitch, a reiteration circuit for automatically reiterating a sound corresponding to a note for so long as the keyswitch for that note is depressed to produce percussion effects, said system comprising:

pulse generating means for producing first, second, third and fourth repetitive substantially rectangular waveform pulse signals each of which has a first voltage level during a substantially greater portion of each cycle than it has a second voltage level, which first voltage level being sufficient when applied as a second input to a logic gate simultaneously with application of said DC potential as a first input to render said logic gate conducting and said second level being incapable of rendering a logic gate conducting when applied thereto simultaneously with appliction of said DC potential, said first and second repetitive signals being out of phase relative to each other and said third and fourth repetitive signals having substantially the same frequency as said first and second repetitive signals and not locked in phase therewith, said third and fourth repetitive signals being out of phase relative to each other; and connecting means for coupling said first, second, third and fourth repetitive pulse signals to first, second, third and fourth groups, respectively, of logic gates whose associated audio gates respectively control first, second, third and fourth preselected sets of notes in a given octave.

6. Apparatus in accordance with claim 5 wherein said connecting means further couples said four repetitive pulse signals to first, second, third and fourth groups, respectively, of logic gates whose associated audio gates respectively control first, second, third and fourth preselected sets of notes in an octave other than said given octave; and wherein at least one of the notes of each of the first, second, third and fourth sets in said other octave is different from the notes of the first, second, third and fourth sets, respectively, in said given octave, whereby to create the effect of random reiteration control.

7. Apparatus in accordance with claim 5, wherein said pulse generating means comprises first and second free-running multivibrators of substantially the same frequency each operative to produce a pair of square waveform signals which are out of phase relative to each other, and pulse-shaping means including means for separately modifying the four square wave signals to produce said first, second, third and fourth repetitive pulse signals.

* * * * *